US006471852B1

(12) United States Patent
Mark et al.

(10) Patent No.: US 6,471,852 B1
(45) Date of Patent: Oct. 29, 2002

(54) PHASE-TRANSFER CATALYZED DESTRUCTION OF FOULING AGENTS IN PETROLEUM STREAMS

(75) Inventors: A. Greaney Mark, Upper Black Eddy, PA (US); Michael Siskin, Randolph, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/551,470

(22) Filed: Apr. 18, 2000

(51) Int. Cl.[7] ..... C10G 9/16
(52) U.S. Cl. ..... 208/48 AA; 208/48 R
(58) Field of Search ..... 208/48 AA, 48 R

(56) References Cited

U.S. PATENT DOCUMENTS 6,007,701 A * 12/1999 Sherman et al. ..... 208/181
6,007,705 A * 12/1999 Greaney et al. ..... 208/251 R

* cited by examiner

*Primary Examiner*—Bekir L. Yildirim
(74) *Attorney, Agent, or Firm*—Ronald D. Hantman

(57) ABSTRACT

The present invention is a process to reduce the fouling of equipment for processing petroleum feedstreams. The fouling is reduced by reducing the presence of peroxides and hydroperoxides in the feedstream. The steps of the process include mixing the feedstream with an aqueous phase containing a base and a phase transfer catalyst. The base reacts with the peroxides and hydroperoxides. The oil phase can then be further processed with minimum fouling of the equipment. The aqueous phase is recycled for reacting with fresh petroleum feedstream.

14 Claims, No Drawings

PHASE-TRANSFER CATALYZED DESTRUCTION OF FOULING AGENTS IN PETROLEUM STREAMS

BACKGROUND OF THE PRESENT INVENTION

The present invention relates to a process to reduce the fouling of equipment for processing petroleum feedstreams. The fouling is due to the presence of peroxides and hydroperoxides in the petroleum feedstream. The fouling is reduced by eliminating the peroxides and hydroperoxides by reaction.

All crude oils contain wppm levels of peroxides and hydroperoxides that were formed by exposure of some crude components, e.g., olefins, conjugated dienes, hydrocarbons containing tertiary hydrogens, pyrroles and indoles, etc. to oxygen in the air. Oxygen, a biradical at room temperature, reacts with these components in minutes (conjugated dienes), to hours (olefins) to weeks (tertiary hydrogens). The presence of even sub-ppm levels of peroxides will lead to fouling of fractionators, heat exchangers, furnaces, etc., and other refinery equipment upon heating. Reaction of peroxides on heating (~100–200° C.)initiates molecular weight growth chemical reactions, such as oligomerizations, polymerizations in pure component feeds, inter—and intramolecular alkylation reactions, etc. For example, a peroxide formed from a conjugated diene can react with other conjugated dienes, with pyrroles, indoles, carbazoles, most phenols, naphthols, thiophenols, naphthalene thiols, etc. An indole peroxide can react with another indole, a conjugated diene, etc., along the path to molecular weight growth reactions. When a feed containing a peroxide is mixed with another feed containing, e.g., conjugated dienes, the molecular weight growth reaction can continue. When the level of molecular weight growth exceeds the solubility of the growth products in solution they precipitate out on metal and other surfaces and foul the surface forming coke (thermal coking). The oligomerization and polymerization reactions are chain reactions. So, one molecule of a peroxide can react with hundreds of molecules of olefins or conjugated dienes (of same or varying structure). Oligomerization vs alkylation reactions will depend on the relative concentrations of species in a feed (e.g., of conjugated dienes vs. aromatics [especially 2+ring aromatics], phenols, thiophenols, etc.). When there are no peroxides in the feed, no chain reactions are initiated and most of these molecular weight growth reactions will be inhibited.

SUMMARY OF THE INVENTION

The present invention is a process to reduce the fouling of equipment for processing petroleum feedstreams. The fouling is reduced by reducing the presence of peroxides and hydroperoxides in the feedstream. The steps of the process include mixing the feedstream with an aqueous phase containing a base and a phase transfer catalyst. The base reacts with the peroxides and hydroperoxides. The oil phase can then be further processed with minimum fouling of the equipment. The aqueous phase is recycled for reacting with fresh petroleum.

DESCRIPTION OF THE PREFERRED EMBODIMENT

The present invention is a process to reduce fouling of equipment used for processing petroleum feeds. The fouling is due to the presence of peroxides and hydroperoxides and their subsequent reactions.

The process includes the following steps: the peroxide-containing petroleum stream is intimately mixed with an aqueous phase containing a base and a phase transfer catalyst to form an oil/water dispersant. The catalyst facilitates the reaction between the organic soluble peroxides and the aqueous soluble base. The petroleum stream and the aqueous phase are allowed to separate. The peroxide-free petroleum stream continues on in the normal refinery. The aqueous phase is then recycled for dispersing more fresh petroleum. It is preferred although not necessary that the invention be carried out in an inert atmosphere.

It is well known that treatment of peroxides with strong base will lead to their conversion (see Petroleum Refining with Chemicals, Kalichevsky and Kobe, 1956). The problem with treating petroleum streams containing organic peroxides and hydroperoxides is that the solubility of the hydroxide ion in petroleum is very low and the solubility of the organic peroxides in the aqueous base is low. This leads to an ineffective reaction. The role of the phase transfer catalyst is to transport the hydroxide ion into the petroleum phase and thereby accelerate the decomposition of the peroxide. The advantages of this process are that it seeks to prevent fouling from occurring, rather than wait for the problem to occur.

Bases preferred are strong bases, e.g., sodium, potassium and ammonium hydroxide, and sodium and potassium carbonate. These may be used as an aqueous solution of sufficient strength, typically at least 20% or as a solid in the presence of an effective amount of water to produce an aqueous solution suitable to result in peroxide and hydroperoxide destruction.

The phase transfer agent is present in a sufficient concentration to result in a treated feed having a decreased peroxide/hydroperoxide content. The phase transfer agent may be miscible or immiscible with the petroleum stream to be treated. Typically, this is influenced by the length of the hydrocarbyl chain in the molecule; and these may be selected by one skilled in the art. While this may vary with the agent selected typically concentrations of 0.1 to 10 wt. % are used. Examples include quaternary ammonium salts, e.g., tetrabutylammonium hydroxide, quaternary phosphonium salts, crown ethers, and open-chain polyethers such as polyethylene glycols, and others known to those skilled in the art either supported or unsupported.

While process temperatures of from 100° C. to 180° C. are suitable, lower temperatures of less than 150° C., less than 120° C. can be used depending on the nature of the feed and phase transfer agent used.

EXAMPLE 1

Twenty milliliters of a real refinery stream, a light coker gas oil (LKGO), which was spiked with benzoyl peroxide to increase its peroxide concentration, was mixed in air with twenty milliliters of an aqueous solution which was 29 wt. % sodium hydroxide and 4.2 wt. % polyethyleneglycol 400 (PEG400). The PEG400 serves as a phase transfer catalyst in this example. The two phases were mixed vigorously by shaking in a 100 ml separatory funnel for sixty seconds at room temperature. After allowing the two phases to separate, a sample of the top organic layer was removed for analysis. The peroxide values were determined by Galbraith Laboratories, Inc. (Knoxville, Tenn.). The initial spiked LKGO had a peroxide value of 30.4 and the treated product had a peroxide value of 8.7 mg/kg. This represents a removal of 71% of the peroxide content in this example.

What is claimed is:

1. A process to reduce peroxides that cause the fouling of equipment for processing petroleum feedstreams in a refinery comprising (a) mixing said petroleum feedstream with an aqueous phase including a phase transfer catalyst and a base; and (b) separating said petroleum feedstream.

2. The process of claim 1 further comprising the step of processing said petroleum feedstream.

3. The process of claim 1 further comprising the step of recycling said aqueous phase.

4. The process of claim 1 wherein said phase transfer catalyst is a polyethylene glycol.

5. The process of claim 1 wherein phase transfer catalyst is a quaternary phosphonium.

6. The process of claim 1 wherein phase transfer catalyst is a crown ether.

7. The process of claim 1 wherein phase transfer catalyst is an open chain polyether.

8. The process of claim 5 wherein phase transfer catalyst is a tetrabutylammonium hydroxide.

9. The process of claim 7 wherein phase transfer catalyst is a polyethylene glycol.

10. The process of claim 1 wherein said base is sodium hydroxide.

11. The process of claim 1 wherein said base is potassium hydroxide.

12. The process of claim 1 wherein said base is ammonium hydroxide.

13. The process of claim 1 wherein said base is sodium carbonate.

14. The process of claim 1 wherein said base is potassium carbonate.

* * * * *